US005819978A

United States Patent [19]

Hlebovy

[11] Patent Number: 5,819,978

[45] Date of Patent: Oct. 13, 1998

[54] TWO PIECE COMPOSITE INLET

[75] Inventor: James C. Hlebovy, Chardon, Ohio

[73] Assignee: Essef Corporation, Chardon, Ohio

[21] Appl. No.: 847,573

[22] Filed: Apr. 24, 1997

[51] Int. Cl.[6] ..... B65D 25/20

[52] U.S. Cl. ..... 220/601; 220/465; 220/DIG. 1

[58] Field of Search ..... 220/465, 601, 220/661, 581, 582, 592, 590, 589, 588, 587, 586, 565, 640, DIG. 1, DIG. 4, DIG. 19, 359, 304

[56] References Cited

U.S. PATENT DOCUMENTS

| | | | |
|---|---|---|---|
| 3,132,761 | 5/1964 | Sylvester . | |
| 3,137,405 | 6/1964 | Gorcey . | |
| 3,266,660 | 8/1966 | Ragettli . | |
| 3,449,182 | 6/1969 | Wiltshire . | |
| 3,843,010 | 10/1974 | Morse et al. . | |
| 3,907,149 | 9/1975 | Harmon . | |
| 4,004,709 | 1/1977 | Simkus | 220/601 |
| 4,360,116 | 11/1982 | Humphrey . | |
| 4,518,558 | 5/1985 | Anway et al. . | |
| 4,589,563 | 5/1986 | Born . | |
| 4,807,531 | 2/1989 | Reynolds et al. . | |
| 4,994,132 | 2/1991 | Liekens et al. . | |
| 5,158,200 | 10/1992 | Vago et al. | 220/465 |
| 5,253,778 | 10/1993 | Sirosh . | |
| 5,285,923 | 2/1994 | Brandon, Jr. | 220/601 |
| 5,287,988 | 2/1994 | Murray . | |
| 5,356,030 | 10/1994 | Biidenbender . | |
| 5,429,845 | 7/1995 | Newhouse et al. . | |
| 5,431,764 | 7/1995 | Syler et al. | 220/465 |
| 5,494,188 | 2/1996 | Sirosh . | |
| 5,509,567 | 4/1996 | Lindahl | 220/465 |
| 5,518,141 | 5/1996 | Newhouse et al. . | |
| 5,538,680 | 7/1996 | Enders . | |
| 5,568,878 | 10/1996 | LeBreton | 220/465 |

*Primary Examiner*—Stephen J. Castellano
*Attorney, Agent, or Firm*—Pearne, Gordon, McCoy & Granger LLP

[57] ABSTRACT

A plastic pressure vessel having an access fitting is disclosed. The pressure vessel has a liner defining a container with an access opening. The fitting comprises a body portion defined by a hollow cylindrical neck portion having an upper annular rim and a radially flaring flanged portion. The fitting further comprises a plastic covering portion surrounding the neck portion and covering and conforming to an upper surface of the flanged portion and conforming to the upper annular rim. The body portion is formed from a plastic material having a higher tensile modulous and higher deflection temperature than the plastic covering portion which forms a fusion bond with the liner.

5 Claims, 5 Drawing Sheets

Fig.5
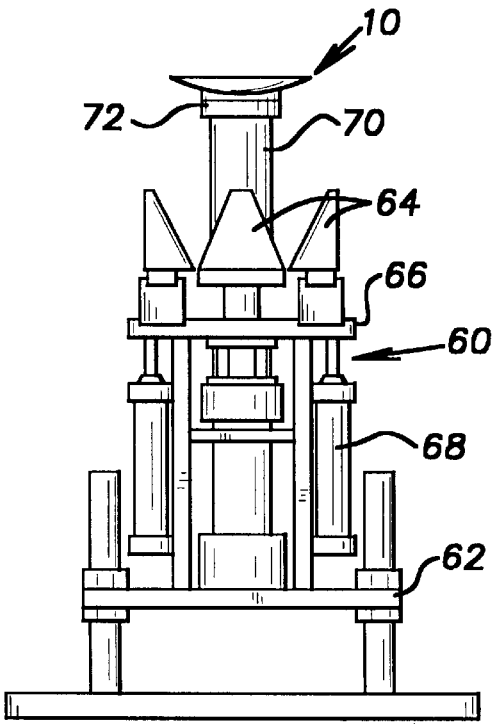
Fig.6
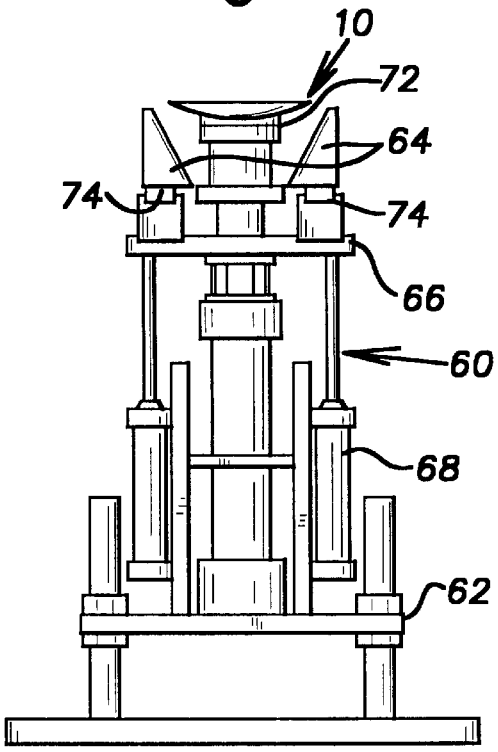
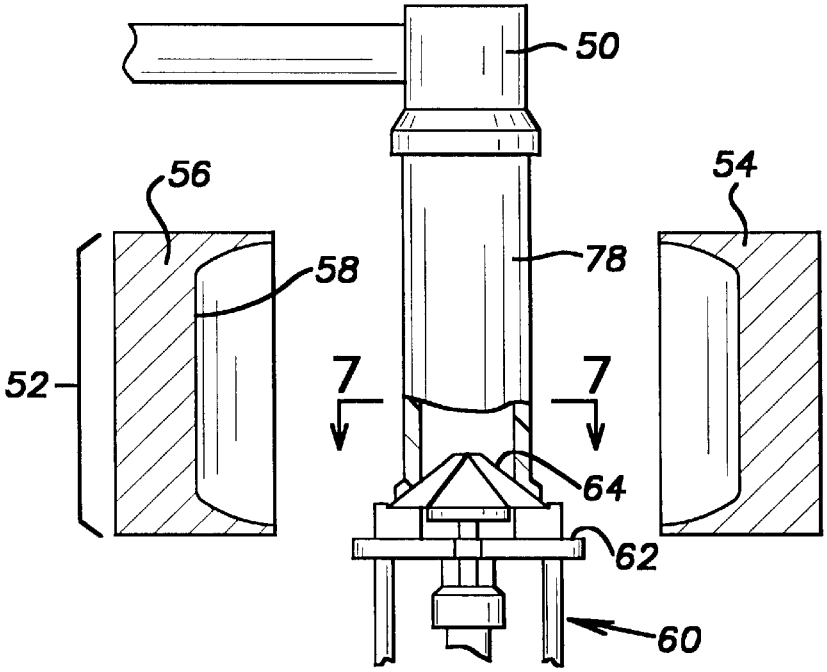
Fig.7

TWO PIECE COMPOSITE INLET

BACKGROUND OF THE INVENTION

This invention relates to hollow plastic articles having a blow-molded or rotationally cast portion fused to a second prefabricated portion. More particularly this invention relates to a plastic pressure vessel having an access fitting fused to a blow-molded or rotationally cast liner which may be filament wound to provide a pressure vessel. There are two basic techniques for fusing a flanged access fitting within a wall portion of a hollow thermoplastic pressure vessel liner. One such technique is set forth in U.S. Pat. No. 4,994,132. In that patent a thermoplastic pressure vessel is manufactured by a rotational casting technique which distributes molten or softened thermoplastic molding material evenly over the inner wall of the mold. A preformed access opening fitting is positioned within the mold cavity in a location which is initially spaced from the mold wall and the thermoplastic material covering the mold wall during the rotational casting operation. The fitting is then retracted into the softened or molten thermoplastic material so that a portion of the fitting is fused to the molding material. When the casting is cooled to ambient temperature a fusion bond results between the fitting and the wall of the molded article.

Another technique for bonding an access fitting to a pressure vessel or tank liner is set forth in U.S. Pat. No. 4,589,563. According to the technique set forth in that patent a pressure vessel or tank liner is formed by a blow molding operation wherein a parison is extruded from an extrusion head and the open mouth of the parison is grasped, expanded, and guided over a preformed access fitting positioned in axial alignment with the parison extrusion head. A portion of a surrounding hollow mold is advanced to define the shape of the blow-molded article and to form the parison around the access fitting.

In practicing both these techniques the side wall of the pressure vessel or liner is molded from a polyethylene resin and the access fitting is preformed from the same or a closely similar resin which may be reinforced with chopped fibers so that the fitting is capable of a fusion bond with the vessel or liner side wall. A disadvantage in this procedure is that the pressure vessel wall or liner is molded from a material with a low deflection temperature and low tensile modulous. Since it is necessary to employ an identical or similar plastic for the access fitting for proper fusion of the fitting to the liner or wall, it is apparent that the fitting will likewise have a low deflection temperature and low tensile modulous. Even with the addition of chopped fibers to strengthen the preformed access fitting, temperature and pressure limitations are apparent.

BRIEF SUMMARY OF THE INVENTION

This invention provides a technique for employing fusion bonding between a pressure vessel wall or liner manufactured from a low deflection temperature and low modulous material such as polyethylene and an access fitting manufactured from a high deflection temperature and high tensile modulous material such as polypropylene or a nylon polypropylene blend which is normally difficult to fusion bond to polyethylene.

According to this invention an access fitting is preformed from a material having a relatively high deflection temperature and high tensile modulous, such as polypropylene or a blend of polypropylene and nylon. The access fitting has a flanged base portion which is intended to be joined to the interior surface of a blow-molded or rotationally cast tank liner and has an axial extending hollow cylindrical portion which provides access to the interior of the liner. At least an upper surface of the flanged base portion, the outer surface of the cylindrical neck portion, and an upper annular rim portion of the cylindrical neck are coated or covered with a plastic which is fusible to the tank liner. The coating or covering may be preformed and joined to the fitting by an adhesive or by a mechanical locking device. Alternately the coating may be applied by an injection molding technique wherein the fitting forms part of the mold.

Since the coating material is fusible with the liner, the fitting and its coating may be fused into a tank liner according to the molding technique set forth in U.S. Pat. Nos. 4,589,563 and 4,994,132, the subject matter of which is incorporated herein by reference.

BRIEF DESCRIPTION OF THE DRAWINGS

FIG. 5 is an elevational view of a parison stretching device;

FIG. 6 is another elevational view of the parison stretching device in an intermediate position;

FIG. 7 is a view partly in section showing the apparatus in a parison receiving position;

DETAILED DESCRIPTION OF THE INVENTION

Figure 1:
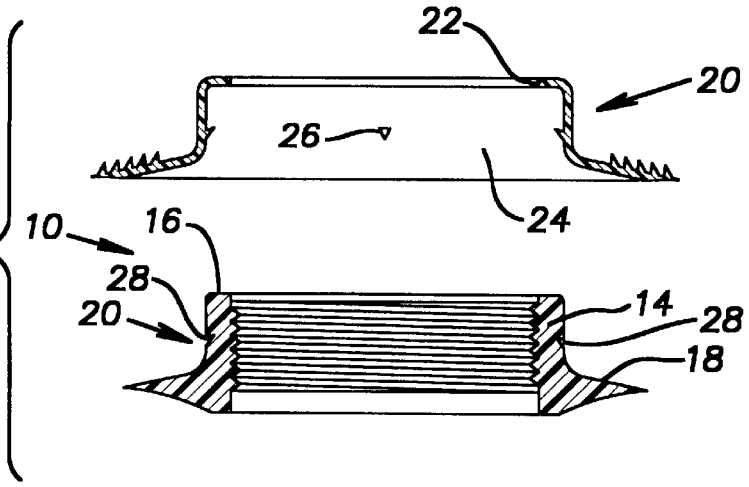
FIG. 1 is a cross sectional, exploded view of an access fitting for a pressure vessel liner according to one aspect of this invention.
Figure 2:
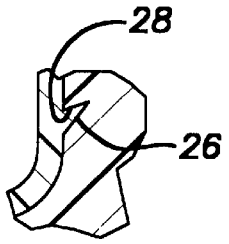
FIG. 2 is an enlarged illustration of the mechanical interlock between the elements illustrated in FIG. 1.

Referring now to FIGS. 1–4 there is illustrated an access fitting 10 for a pressure vessel. The access fitting 10 comprises a body portion 12 defined by a hollow cylindrical neck portion 14 having an upper annular rim 16 and a radially flaring flanged portion 18. The fitting 10 further comprises a covering portion 20 which is adapted to surround the neck portion 14 and conform to the upper surface of the flanged portion 18. The covering portion 20 includes a radially inwardly extending lip 22. The covering 20 has an inner surface 24 which conforms to the outer surface of the body portion 12. In FIG. 1 the inner surface 24 is provided with a plurality of projecting tangs 26 which are received in recesses 28 in the cylindrical side wall 14 so that the covering portion and the body portion may be locked together.

Figure 3:
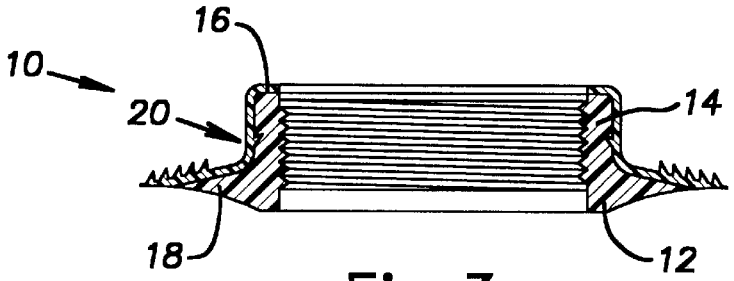
FIG. 3 is a cross sectional view of an access fitting according to a further aspect of this invention.
Figure 4:
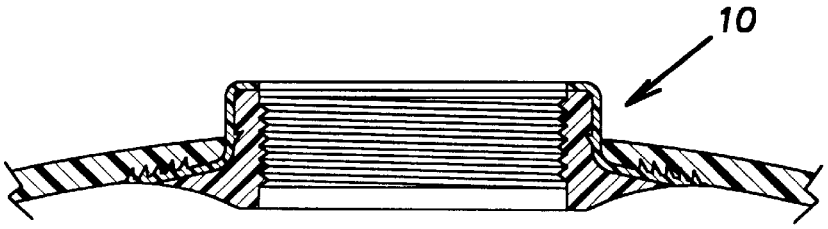
FIG. 4 is an elevational view of a pressure vessel, with portions broken away for clarity, illustrating the access fitting fused to the liner of the pressure vessel.

Alternately the covering portion 20 and the body portion 14 may be cemented together to form the access fitting 10 as is illustrated in FIG. 3.

The body portion 12 is preformed such as by injection molding from a polypropylene-nylon blend such as Akuloy produced by DSM Engineering Plastics of Evansville, Ind.

This compound does not readily fuse with conventional tank liner materials such as polyethylene but exhibits desirable tensile and high temperature characteristics which are desirable for access fittings. The covering portion 20 is preformed from polyethylene which will readily fuse from the liner and the covering may be mechanically locked to the body portion or cemented thereto as was previously discussed. Also the covering may be injection molded onto the body portion.

The access fitting 10 is fused to a polyethylene tank liner 30 according to the technique set forth in U.S. Pat. No. 4,589,563, or in accordance with the rotational casting operation set forth in U.S. Pat. No. 4,994,132.

In accordance with the preferred procedure set forth in U.S. Pat. No. 4,589,563 and as is illustrated in FIGS. 5 through 9, a pressure vessel 100 (FIG. 10) may be produced by an apparatus which includes a conventional parison extrusion head 50, a segmented hollow mold 52 which includes a pair of mold halves 54 and 56 having an inside surface which defines the outside surface of the pressure vessel 100 to be molded, and a parison stretching assembly 60.

The assembly 60 comprises a base 62 which supports a plurality of curved plates 64. The plates are arranged on a first platform 66 mounted on rod and piston assemblies 68. A rod 70 is axially disposed through an appropriate hole in the platform 66 and supports a second platform 72 which is provided to hold the fitting 10 as shown. The rod and piston assemblies 68 are provided to move the platform 66 and the plates 64 from a lower position below the platform 72 to an upper position above the platform 72 as shown in FIGS. 5, 6 and 7. (In FIG. 6 one of the plates 42 has been cut away for the sake of clarity). The plates are pivotally secured to the platform 66 by pins 74 which permits the plates to turn radially inwards so that in the upper position they can form a protective dome over the fitting 10, as shown in FIG. 7. Pneumatically-operated control rods are used to pivot the plates 64 about its pin 74. These rods have been omitted for the sake of clarity.

At the beginning to the molding process the first platform 66 is raised and the plates are closed around the platform 72 and the fitting 10 disposed thereon.

Figure 8:
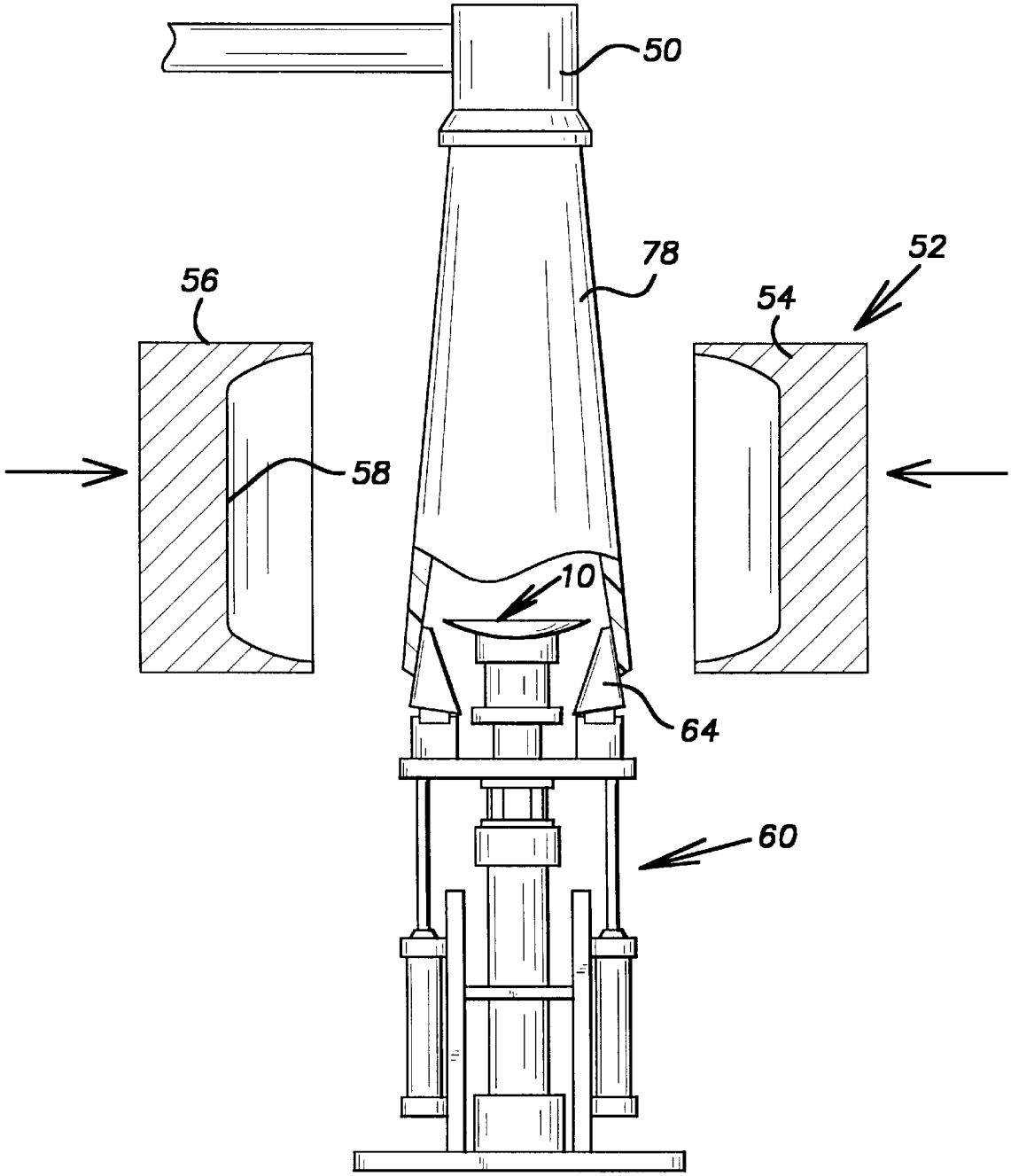
FIG. 8 is an elevational view of a parison stretching device illustrating the device in an intermediate molding position.

A tube or parison 78 is next extruded downwardly by the extrusion head 50 and is in a flowable plastic state in the condition illustration in FIGS. 7 and 8. The extrusion rate is inversely proportional to the extruded wall thickness of the parison so that a fast extrusion rate produces a relatively thin wall and a slow rate produces a relatively thick wall.

When the parison reaches the position illustrated in, FIG. 7 of the drawings, it has just encircled the plurality of inwardly directed plates 64. As previously mentioned, in this position the plates form a protected dome over the portion 14. Next the plates separate as they move downwardly to pull down the parison to envelope the fitting 10 as is shown in FIG. 8.

Figure 9:
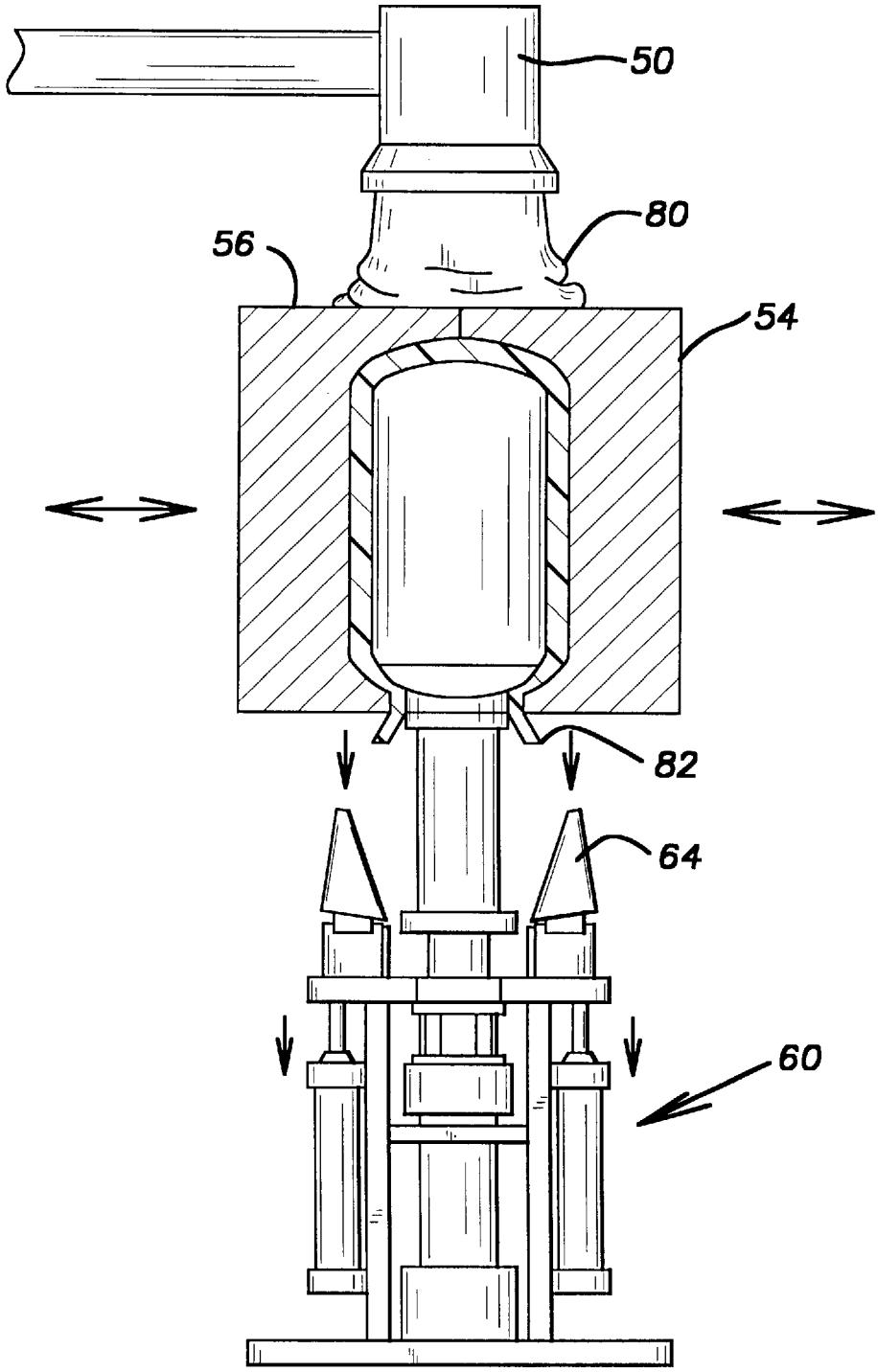
FIG. 9 is an elevational view of the apparatus illustrated in FIG. 5 showing the mold in a closed position.

When the parison has completed its travel to envelope the fitting 10, the mold segments 54 and 56 are moved radially inwardly to the position illustrated in FIG. 9. The mold surface 58 surrounds a major portion of the parison and pinches off the top and bottom of the parison as indicated at the location 80 and 82. Since the parison is in a hot moldable condition the covering portion 20 of the fitting 10 is fused to the liner wall formed by the parison.

Figure 10:
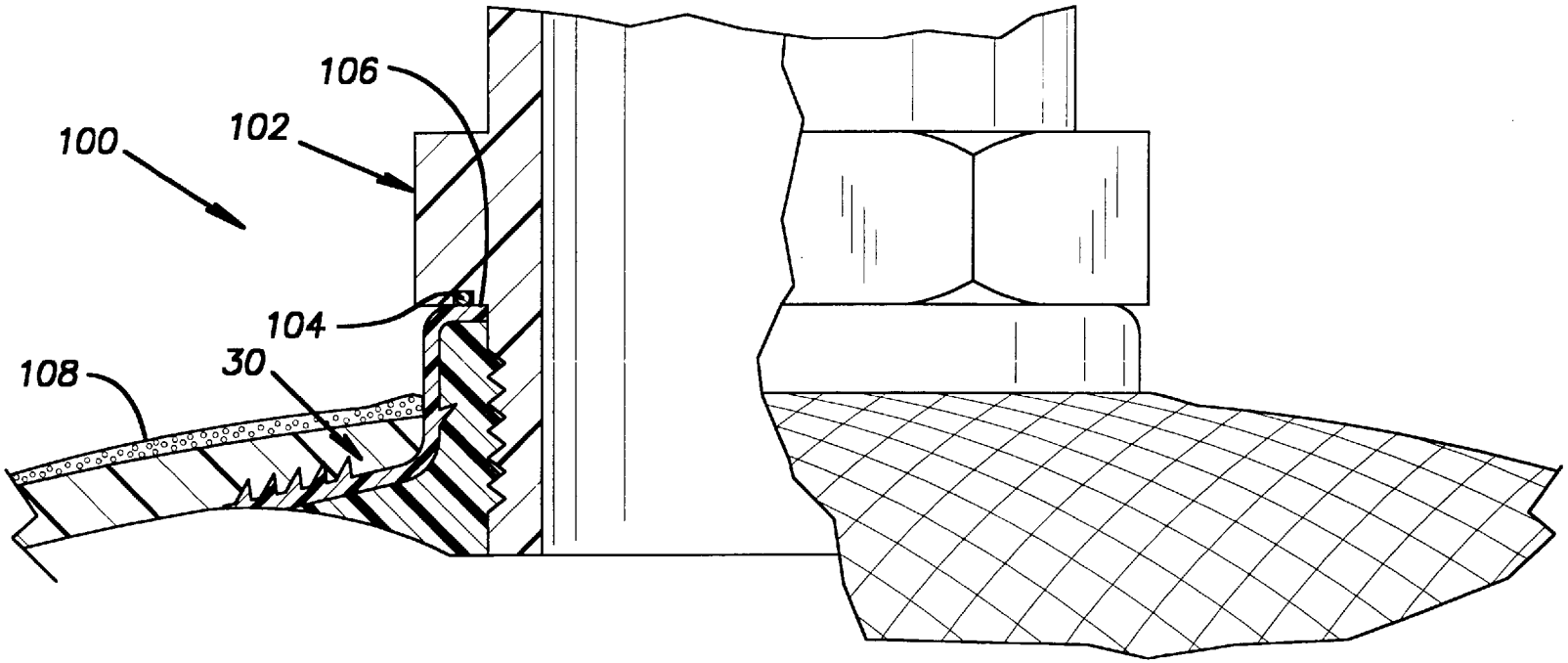
FIG. 10 is a fragmentary illustration of a pressure vessel illustrating the fitting in combination with an access conduit.

As may be seen in FIG. 10 the pressure vessel 100 may be provided with a plumbing connection 102 which is threaded into the fitting 10. The connection 102 is provided with an O-ring 104 which provides a seal between the plumbing connection 102 and an upper annular rim 106 of the fitting 10. Thus, any leakage of fluids through the thread connection between the plumbing connection 102 and the fitting 10 and/or the interface between the portions 14 and 20 is blocked by the O-ring 104.

The polyethylene liner 30 may be, and typically is, wrapped with a helically wound resin-impregnated filament to form a winding layer 108. The winding layer 108 is applied with conventional filament winding techniques.

Although the preferred embodiment of this invention has been shown and described, it should be understood that various modifications and rearrangements of the parts may be restored to without departing from the scope of the invention as disclosed and claimed herein.

What is claimed is:

1. A plastic pressure vessel comprising a plastic liner defining a container having an access opening, an access fitting for said access opening, said fitting comprising a body portion defined by a hollow cylindrical neck portion having an upper annular rim and a radially flaring flanged portion, said fitting further comprising a plastic covering portion surrounding said neck portion and covering and conforming to an upper surface of said flanged portion and conforming to said upper annular rim, said body portion being formed from a plastic material having a higher tensile modulous and higher deflection temperature than said plastic covering portion and said plastic covering portion forming a fusion bond with said liner.

2. A plastic pressure vessel according to claim 1 wherein said body portion is polypropylene, said covering portion is polyethylene, and said liner is polyethylene.

3. A plastic pressure vessel according to claim 1 wherein said covering portion is mechanically interlocked with said body portion.

4. A plastic pressure vessel according to claim 1 wherein said covering portion is adhesively bonded to said body portion.

5. A plastic pressure vessel comprising a plastic liner defining a container having an access opening, an access fitting foresaid access opening, said fitting comprising a body portion defined by a hollow cylindrical neck portion having an upper annular rim and a radially flaring flanged portion, said fitting further comprising a plastic covering portion surrounding said neck portion and covering and conforming to an upper surface of said flanged portion and conforming to said upper annular rim, said body portion being formed from a plastic material having a higher tensile modulous and higher deflection temperature than said plastic covering portion and said plastic covering portion being fused to said liner, a plumbing connection threaded into said access fitting, and an O-ring seal between said plumbing connection and said upper annular rim.

* * * * *